United States Patent [19]

Tsuda et al.

[11] Patent Number: 4,636,255

[45] Date of Patent: Jan. 13, 1987

[54] ELECTROLESS PLATING BATH FOR FORMING A NICKEL ALLOY COATING HAVING A HIGH PHOSPHORUS CONTENT

[75] Inventors: Jou Tsuda, 43, Yashiki, Kitamajima Charu-cho, Ama-gun, Japan; Masami Ishii, Toyota, Japan

[73] Assignees: Aisin Seiki Kabushiki Kaisha, Kariya; Jou Tsuda, Ama, both of Japan

[21] Appl. No.: 736,859

[22] Filed: May 22, 1985

[30] Foreign Application Priority Data

May 24, 1984 [JP] Japan ..... 59-105877

[51] Int. Cl.[4] ..... C23C 18/36

[52] U.S. Cl. ..... 106/1.22; 106/1.27; 427/443.1

[58] Field of Search ..... 106/1.27, 1.22; 427/443.1

[56] References Cited

U.S. PATENT DOCUMENTS

| | | | |
|---|---|---|---|
| 3,024,134 | 3/1962 | Nixon | 106/1.27 |
| 3,060,059 | 10/1962 | Sickles | 106/1.27 |
| 3,148,072 | 9/1964 | West | 106/1.27 |
| 3,416,955 | 12/1968 | Makowski | 106/1.27 |
| 3,565,667 | 2/1971 | Klingspor | 106/1.27 |
| 4,483,711 | 11/1984 | Harbulak | 106/1.22 |

*Primary Examiner*—John D. Smith

*Attorney, Agent, or Firm*—Oblon, Fisher, Spivak, McClelland, & Maier

[57] ABSTRACT

An electroless plating bath for forming a nickel-phosphorus alloy coating having a high phosphorus content contains in water nickel ions, hypophosphite as a reducing agent for nickel ions, a pH adjustor, a pH buffering agent, a small amount of a stress reducing agent and tri(alkali metal) N-(2-hydroxyethyl)ethylenediamine-N, N', N'-triacetate as a first phosphorus deposition promotor. It may further contain at least one sulfate selected from ammonium sulfate, lithium sulfate, potassium sulfate and sodium sulfate as a second phosphorus deposition promotor.

9 Claims, 4 Drawing Figures

ELECTROLESS PLATING BATH FOR FORMING A NICKEL ALLOY COATING HAVING A HIGH PHOSPHORUS CONTENT

BACKGROUND OF THE INVENTION

1. Field of the Invention

This invention relates to an electroless plating bath for forming a coating of an alloy of nickel and phosphorus on a metal or nonmetal surface.

2. Description of the Prior Art

It is known that an electroless plating bath containing hypophosphite as a reducing agent can be used to form a coating of an alloy of nickel and phosphorus, as disclosed in, for example, KINZOKU HYOMEN GIJUTSU (Metal Surface Treating Techniques), vol. 32, No. 12 (1981), pages 600 to 609. The electroless plating baths are classified into acidic and alkaline ones. The alkaline baths are classified into caustically and ammoniacally alkaline ones. The nickel-phosphorus alloy coatings which these baths can form, however, have a low phosphorus content as expressed by atomic percentage relative to nickel. The coating formed by an ammoniacally alkaline bath has a phosphorus content of only 3 to 5%. The coating formed by an acidic bath has a phosphorus content of only 8 to 10%. Although a caustically alkaline bath can form a coating having a somewhat higher phosphorus content (dozens of percent) than an acidic bath, it is practically unusable, since it has a very low deposition rate, which is less than a half of that of an acidic bath, and moreover lacks stability.

It is known that a coating of an alloy of nickel and phosphorus having a phosphorus content of only 3 to 5% has a face-centered cubic lattice structure, and that a coating having a phosphorus content of about 7.4% or above has an amorphous structure.

It is also known from the results of research on an amorphous alloy made by, for example, the fast cooling of a liquid metal that the structure and properties of a two-component amorphous alloy composed of a metal and a semi-metal depend largely on the semimetal, or in the instant case, phosphorus content thereof. Researchers in various fields of active research on amorphous alloys are predominantly of the opinion that the majority of amorphous alloys of nickel and phosphorus having practically aceeptable properties have a phosphorus content of 15 to 25 atom %. The alloy coating formed by electroless plating is not an exception. The inventor of this invention has made extensive research including the quantitative analysis of nickel and phosphorus in their alloys by EPMA and the X-ray diffraction thereof, and found that the coatings having a phosphorus content of 7 to 15 atom % have an amorphous structure, but are not alloys which are practically acceptable for use under severe conditions from the standpoints of resistance to corrosion and wear, deformability and nonmagnetic property. A plating bath containing hypophosphite as a reducing agent is more often used to form a coating of an alloy of nickel and phosphorus than any other type of bath. In order to increase the phosphorus content of the coating, it is generally believed effective to increase the hypophosphite content of the bath and lower its pH. These expedients, however, have fatal defects. The excessive addition of hypophosphite brings about the excessive accumulation of phosphorous acid ions and the resulting formation of nickel phosphite, thereby accelerating the decomposition of the bath. The lowering of the pH of the bath brings about a drastic reduction in its deposition capacity.

SUMMARY OF THE INVENTION

It is an object of this invention to provide a stable electroless plating bath which contains only an acceptable amount of hypophosphite as a reducing agent and has an appropriate pH, and which can form an amorphous coating of an alloy of nickel and phosphorus having a phosphorus content of 15 to 25 atom % at a satisfactory deposition rate.

This object is attained by an electroless plating bath which comprises an aqueous solution containing nickel ions, hypophosphite as a nickel ion reducing agent, a pH adjustor, a pH buffering agent, a nickel ion sequestering agent, a small amount of a stress reducing agent and tri(alkali metal) N-(2-hydroxyethyl)ethylenediamine-N, N', N'-triacetate as a first phosphorus deposition promotor. The first phosphosrus phosrus deposition promotor may, for example, be trisodium N-(2-hydroxyethyl)ethylenediamine-N, N', N'-triacetate:

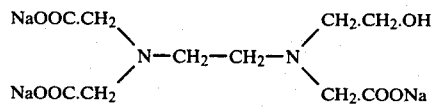

The bath of this invention may further contain a second phosphorus deposition promotor. It may comprise one or more sulfates selected from ammonium sulfate, lithium sulfate, potassium sulfate and sodium sulfate. The second phosphorus deposition promotor exhibits its effect of enabling a deposit with a high phosphorus content only when used in combination with the first phosphorus deposition promotor.

The bath of this invention enables the deposition of a nickel alloy coating having a high phosphorus content if the first phosphorus deposition promotor is appropriately added thereto. The promotor, for example, trisodium N-(2-hydroxyethyl)ethylenediamine-N, N', N'-triacetate ($C_{10}H_{15}N_2Na_3O_7$), effectively sequesters free nickel ions in the bath. Therefore, the bath is greatly improved in stability, deposition rate and uniformity of deposition. If required, the second phosphorus deposition promotor may be added to the bath to enable the deposition of a nickel alloy coating having a still higher phosphorus content.

DETAILED DESCRIPTION OF THE INVENTION

Figure 1:
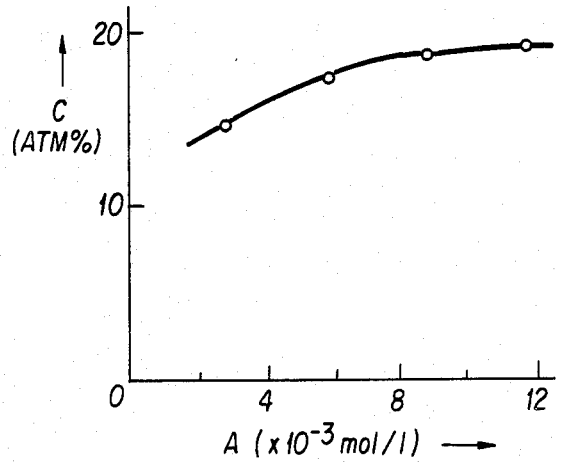
FIG. 1 is a graph showing the phosphorus contents C of the nickel-phosphorus alloy coatings formed in the electroless plating baths according to EXAMPLES 1 to 4 of this invention in relation to the amount A of $C_{10}H_{15}N_2Na_3O_7$ added to the bath.

The invention will now be described in detail with reference to a variety of examples thereof and a comparative example. In each of these examples, a nickel-phosphorus alloy coating was formed on a layer of copper carried on one side of an epoxy-glass laminate and having a thickness of 35 microns. After the coating had been formed, the copper was separated from the epoxy-glass laminate and melted away from the coating by immersion in an aqueous solution containing 275 g of ammonium persulfate and 6 g of sulfuric acid having a specific gravity of 1.84 per liter. Then, the remaining alloy coating was subjected to ultrasonic cleaning in pure water at an oscillating frequency of 30 kHz to prepare a refined specimen for the quantitative analysis of the alloy elements by EPMA and the structural analysis of the alloy by X-ray diffraction. In all of the comparative example and the examples of this invention, the coating was formed by dipping in a bath fluidized by stirring and having a temperature of 90° C. for a period of 60 minutes.

COMPARATIVE EXAMPLE

A nickel-phosphorus alloy coating was formed on a copper base, as hereinabove described, by employing a bath of the following composition:

| | |
|---|---|
| Nickel sulfate | 0.13 mol/liter |
| Sodium hypophosphite | 0.09 mol/liter |
| Sodium citrate | 0.17 mol/liter |
| Sodium saccharate | 0.0042 mol/liter |

Dilute sulfuric acid and aqueous ammonia in quantities enabling the bath to have a pH of 5.0
Pure water in a quantity making a total bath volume of one liter.

A refined specimen was prepared from the coating as hereinabove described, and the quantitative analysis of its components by EPMA gave the following results:

| Quantitative Analysis - Atom % | |
|---|---|
| Nickel | 89.83% |
| Phosphorus | 10.17% |

EXAMPLES 1 TO 4

Each of the baths according to EXAMPLES 1 to 4 was basically of the same composition with the bath of the Comparative Example, but further contained $C_{10}H_{15}N_2Na_3O_7$ as the first phosphorus deposition promotor, of which the amount differed from one example to another as shown below. Each bath had a pH of 5.0.

| Amount of $C_{10}H_{15}N_2Na_3O_7$ - mol/liter | |
|---|---|
| EXAMPLE 1 | 0.0029 |
| EXAMPLE 2 | 0.0058 |
| EXAMPLE 3 | 0.0087 |
| EXAMPLE 4 | 0.0116 |

EXAMPLES 5 TO 11

Each of the baths according to EXAMPLES 5 to 11 was basically of the same composition with the bath of EXAMPLE 3, but further contained ammonium sulfate as the second phosphorus deposition promotor, of which the amount differed from one example to another as shown below. Each bath had a pH of 5.0.

| Amount of Ammonium Sulfate - mol/liter | |
|---|---|
| EXAMPLE 5 | 0.0378 |
| EXAMPLE 6 | 0.0757 |
| EXAMPLE 7 | 0.1135 |
| EXAMPLE 8 | 0.1514 |
| EXAMPLE 9 | 0.1892 |
| EXAMPLE 10 | 0.2270 |
| EXAMPLE 11 | 0.2649 |

EXAMPLES 12 TO 18

Each of the baths according to EXAMPLES 12 to 18 was basically of the same composition with the bath of EXAMPLE 3, but further contained lithium sulfate as the second phosphorus deposition promotor, of which the amount differed from one example to another as shown below. Each bath had a pH of 5.0.

| Amount of Lithium Sulfate - mol/liter | |
|---|---|
| EXAMPLE 12 | 0.0391 |
| EXAMPLE 13 | 0.0782 |
| EXAMPLE 14 | 0.1172 |
| EXAMPLE 15 | 0.1563 |
| EXAMPLE 16 | 0.1954 |
| EXAMPLE 17 | 0.2345 |
| EXAMPLE 18 | 0.2735 |

EXAMPLES 19 TO 25

Each of the baths according to EXAMPLES 19 to 25 was basically of the same composition with the bath of EXAMPLE 3, but further contained potassium sulfate as the second phosphorus deposition promotor, of which the amount differed from one example to another as shown below. Each bath had a pH of 5.0.

| Amount of Potassium Sulfate - mol/liter | |
|---|---|
| EXAMPLE 19 | 0.0287 |
| EXAMPLE 20 | 0.0574 |
| EXAMPLE 21 | 0.0861 |
| EXAMPLE 22 | 0.1148 |
| EXAMPLE 23 | 0.1435 |
| EXAMPLE 24 | 0.1722 |
| EXAMPLE 25 | 0.2008 |

A refined specimen was prepared from the coating deposited in each EXAMPLE and subjected to quantitative analysis by EPMA and X-ray diffraction, as hereinbefore described. The following results were obtained:

| | Quantitative Analysis - Atom % | |
|---|---|---|
| EXAMPLE | Nickel | Phosphorus |
| 1 | 84.92 | 15.08 |
| 2 | 82.52 | 17.48 |
| 3 | 81.04 | 18.96 |
| 4 | 80.84 | 19.16 |
| 5 | 80.68 | 19.32 |
| 6 | 80.22 | 19.78 |
| 7 | 79.78 | 20.22 |
| 8 | 79.46 | 20.54 |
| 9 | 78.92 | 21.08 |
| 10 | 78.56 | 21.44 |
| 11 | 78.78 | 21.22 |
| 12 | 79.11 | 20.89 |
| 13 | 76.98 | 23.02 |

-continued

| Quantitative Analysis - Atom % | | |
|---|---|---|
| EXAMPLE | Nickel | Phosphorus |
| 14 | 75.69 | 24.31 |
| 15 | 74.78 | 25.22 |
| 16 | 75.80 | 24.20 |
| 17 | 75.88 | 24.12 |
| 18 | 76.62 | 23.38 |
| 19 | 77.20 | 22.80 |
| 20 | 76.67 | 23.33 |
| 21 | 76.30 | 23.70 |
| 22 | 75.66 | 24.34 |
| 23 | 74.94 | 25.06 |
| 24 | 75.14 | 24.86 |
| 25 | 76.15 | 23.85 |

As is obvious from the foregoing, all of the coatings formed according to EXAMPLES 1 to 25 were found to have a definitely higher phosphorus content than that (10.17%) of the coating according to the Comparative Example. The results of EXAMPLES 1 to 4 are graphically shown in FIGURE 1, the results of EXAMPLES 5 to 11 in FIG. 2, the results of EXAMPLES 12 to 18 in FIG. 3, and the results of EXAMPLES 19 to 25 in FIG. 4.

The structural analysis by X-ray diffraction confirmed that all of the coatings according to EXAMPLES 1 to 25 had an amorphous structure, as their X-ray diffraction patterns included only a single broad band which was characteristic of the X-ray diffraction pattern of any amorphous substance. This was a natural consequence of their phosphorus content which was higher than the lower limit of 7.4 atom % at which the formation of an amorphous structure was generally believed to start.

The mechanism by which phosphorus is incorporated into the coating has not yet been clarified. It is not clear, either, whether the phosphorus found in the coating is in its elemental form or in the form of a compound of nickel and phosphorus. It is, however, true that the phosphorus content of the alloy has an important bearing on the formation of an amorphous structure. It can also be concluded in view of the results of research on the amorphous alloys made by the rapid cooling of liquid metals that the amorphous alloys of nickel and phosphorus having a phosphorus content of 15 to 25 atom % are particularly excellent in resistance to corrosion and wear, deformability and nonmagnetic property.

The effectiveness of phosphorus for the formation of an amorphous structure and the advantages of the bath of this invention containing the phosphorus deposition promotor or promotors have been ascertained by the results of quantitative analysis and X-ray diffraction as hereinabove stated. Moreover, it is presumed that a large amount of hydrogen which is generated in the interfacial area between the material to be coated and the solution in the bath during the electroless plating operation inhibits the arrangement of atoms which would otherwise form a crystalline structure. This phenomenon is believed to assist the formation of an amorphous structure.

The phosphorus content of a nickel-phosphorus alloy coating which can be formed by an electroless plating bath containing hypophosphite as a reducing agent is generally from 3 to 5 atom % in case the bath is ammoniacally alkaline, from 8 to 10 atom % in case it is acidic, and up to dozens of atom percent in case it is caustically alkaline. The results of analysis by X-ray diffraction teach that the coatings having a phosphorus content of at least 7.4 atom % are amorphous. It is known that phosphorus causes the structure of such alloy to change from a finely crystalline structure to a finely crystalline plus amorphous structure (primarily crystalline) and from it to an amorphous plus finely crystalline structure (primarily amorphous). In order to obtain an amorphous structure which is substantially free from any finely crystalline portion, it is necessary to form a coating having a relatively high phosphorus content in the range of 15 to 25 atom %. It is presumed that only a coating having a phosphorus content in the vicinity of 25 atom % has an almost completely amorphous structure.

Figure 2:
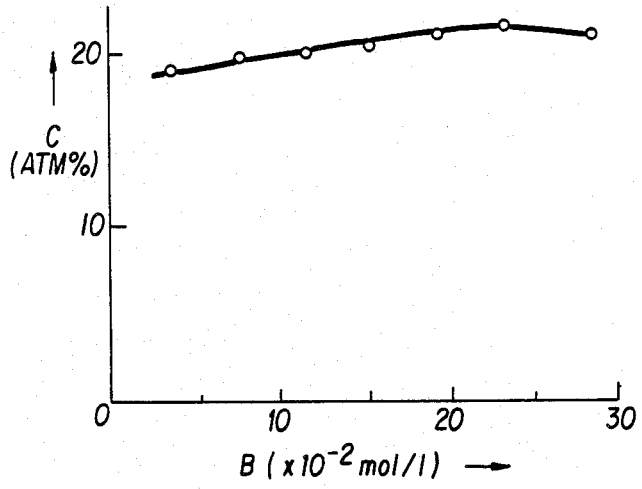
FIG. 2 is a graph showing the phosphorus contents C of the coatings formed in the baths according to EXAMPLES 5 to 11 in relation to the amount B of ammonium sulfate added to the bath.
Figure 3:
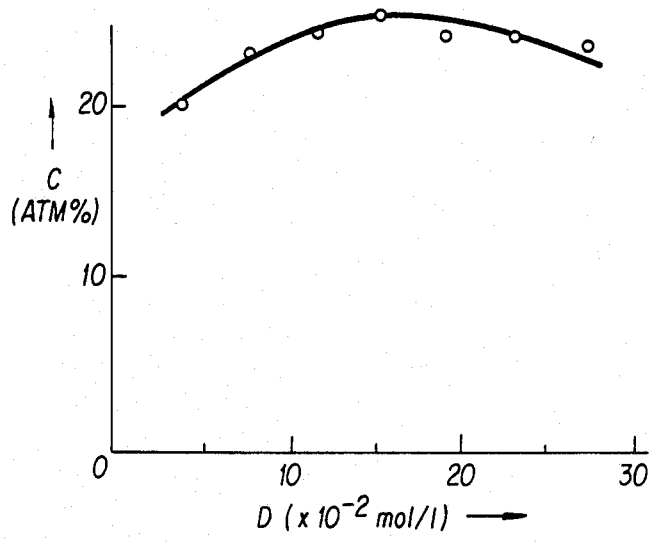
FIG. 3 is a graph showing the phosphorus contents C of the coatings formed in the baths according to EXAMPLES 12 to 18 in relation to the amount D of lithium sulfate added to the bath.
Figure 4:
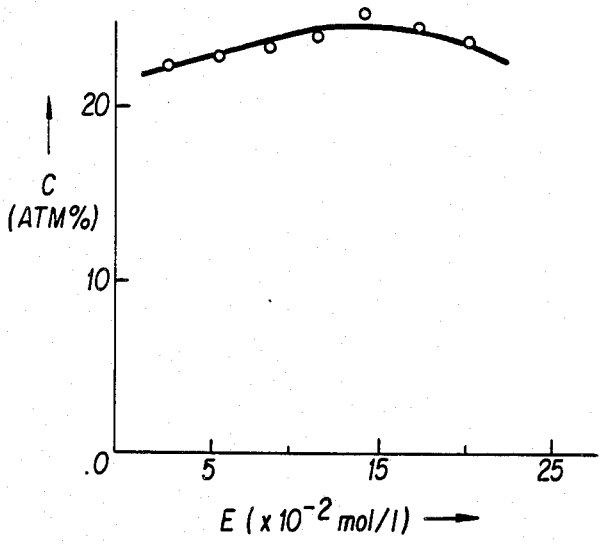
FIG. 4 is a graph showing the phosphorus contents C of the coatings formed in the baths according to EXAMPLES 19 to 25 in relation to the amount E of potassium sulfate added to the bath.

According to EXAMPLES 1 to 4 of this invention, it was possible to deposit a coating having a phosphorus content of 15.08 to 19.16 atom % by using a bath containing the first phosphorus deposition promotor, as hereinabove described and shown in FIG. 1. According to EXAMPLES 5 to 25, it was possible to deposit a coating having a phosphorus content up to a maximum of 25.22 atom % by using a bath containing the first and second phosphorus deposition promotors, as shown in FIGS. 2 to 4. Those coatings were all a substantially completely amorphous alloy having a high phosphorus content.

In order to form a nickel-phosphorus alloy coating having a high phosphorus content in an electroless plating bath containing hypophosphite as a reducing agent, there has hitherto been no alternative but to increase the amount of the hypophosphite or lower the pH of the bath. The fatal drawbacks of these expedients have, however, already been pointed out.

According to this invention, it is sufficient to employ as small a quantity of hypophosphite as 0.09 mol per liter and yet it is possible to obtain an alloy of nickel and phosphorus having a desired high phosphorus content in the range of 15 to 25 atom % as shown in FIGS. 1 to 4 only if the amount of the first phosphorus deposition promotor or the first and second phosphorus deposition promotors is appropriately controlled.

The N-(2-hydroxyethyl)ethylenediamine-N,N',N'-triacetate used as the first phosphorus deposition promotor has excellent sequestering properties. If it is added to the bath of the basic composition according to the Comparative Example, it changes the color of the bath to somewhat blue when added in the amount of 0.0029 mol per liter, almost completely blue when added in the amount of 0.0058 mol per liter, and completely blue when added in the amount of 0.0087 mol per liter. These phenomena confirm that the agent has excellent sequestering properties in addition to its phosphorus deposition promoting power. It sequesters the free nickel ions which tend to combine with phosphorous acid ions in the bath during the plating operation, thereby reducing the amount of free nickel ions in the bath and increasing the accumulation of phosphorous acid ions therein. Thus, it greatly contributes to stabilizing the bath and prolonging its life.

In each of EXAMPLES 5 to 25, the bath contains only one sulfate as the second phosphorus deposition promotor. These examples have, however, been given to show primarily the effectiveness of the individual sulfates when used alone. This invention, of course, does not preclude the simultaneous use of more than one sulfate selected from ammonium sulfate, lithium sulfate, potassium sulfate and sodium sulfate, depending on the properties of the amorphous nickel-phosphorus alloy to be deposited.

A series of tests were conducted to ascertain the corrosion resistance of the coating formed by the electroless plating bath embodying this invention, as will hereinafter be described.

TEST 1

A nickel-phosphorus alloy coating having a thickness of 10 microns was formed on a sheet of steel designated as SPC-1 by using the bath of EXAMPLE 15 which has already been described as containing 0.1563 mol of lithium sulfate per liter as the second phosphorus deposition promotor and being capable of forming a coating having a phosphorus content up to 25.22 atom %. The coating was subjected to salt spray test according to the conditions specified by JIS (Japanese Industrial Standard). The test confirmed that the coating had a very high degree of corrosion resistance, as no corrosion was found for 960 hours. The test results can be interpreted to indicate that the coating had a completely amorphous structure not containing any finely crystalline portion, and that it was a good amorphous structure having no grain boundary and little segregation and therefore not forming any local cell easily.

TEST 2

The procedure of TEST 1 was repeated for preparing a test specimen, but 30% of the surface area of the specimen for TEST 2 was left uncoated and had iron exposed. The specimen was dipped in a 1N solution of hydrochloric acid and left therein for about two hours, while a 35% aqueous solution of hydrogen peroxide was being dropped thereinto. Although the exposed iron portion was melted away, no change was found in the portion coated with the nickel-phosphorus alloy. The test results can be interpreted to confirm that the coating had a completely amorphous structure containing 25.22 atom % of phosphorus as obtained in EXAMPLE 15.

A comparative test was conducted under the same conditions for the nickel-phosphorus alloy coating which had been formed by a conventional electroless plating bath and had a phosphorus content of 8 to 10 atom %. The coating began to melt when about five minutes had passed, and melted away completely when about seven or eight minutes had passed.

What is claimed is:

1. An electroless plating bath for forming a nickel-phosphorus alloy coating having a high phosphorus content of 15 to 25 atom %, said bath containing nickel ions, hypophosphite as a reducing agent for said nickel ions, a pH adjustor, a pH buffering agent, a nickel ion sequestering agent, a small amount of a stress reducing agent and tri(alkali metal) N-(2-hydroxyethyl) ethylenediamine-N, N', N'-triacetate as a first phosphorus deposition promotor in water.

2. A bath as set forth in claim 1, wherein said first phosphorus deposition promotor comprises trisodium N-(2-hydroxyethyl) ethylenediamine-N, N', N'-triacetate.

3. An electroless plating bath for forming a nickel-phosphorus alloy coating having a high phosphorus content of 15 to 25 atom %, said bath containing nickel ions, hypophosphite as a reducing agent for said nickel ions, a pH adjustor, pH buffering agent, a nickel ion sequestering agent, a small amount of a stress reducing agent and tri(alkali metal) N-(2-hydroxyethyl) ethylenediamine-N, N', N'-triacetate as a first phosphorus deposition promotor in water, and further containing a second phosphorus deposition promotor which comprises at least one sulfate selected from the group consisting of ammonium sulfate, lithium sulfate, potassium sulfate and sodium sulfate.

4. An electroless plating bath for forming a nickel-phosphorus alloy coating having a high phosphorus content of 15 to 25 atom %, said bath comprising an aqueous solution containing nickel sulfate, sodium hypophosphite, sodium citrate, sodium saccharate, dilute sulfuric acid, aqueous ammonia and trisodium N-(2-hydroxyethyl) ethylenediamine-N, N', N'-triacetate.

5. An electroless plating bath for forming a nickel-phosphorus alloy coating having a high phosphorus content of 15 to 25 atom %, said bath comprising an aqueous solution containing nickel sulfate, sodium hypophosphite, sodium citrate, sodium saccharate, dilute sulfuric acid, aqueous ammonia and trisodium N-(2-hydroxyethyl) ethylenediamine-N, N', N'-triacetate, and further containing at least one sulfate selected from the group consisting of ammonium sulfate, lithium sulfate, potassium sulfate and sodium sulfate.

6. A bath as set forth in claim 4, wherein said solution contains 0.09 mol of said sodium hypophosphite per liter.

7. A bath as set forth in claim 6, wherein said solution has a pH of 5.0.

8. A bath as set forth in claim 5, wherein said solution contains 0.09 mol of said sodium hypophosphite per liter.

9. A bath as set forth in claim 8, wherein said solution has a pH of 5.0.

* * * * *

UNITED STATES PATENT AND TRADEMARK OFFICE

CERTIFICATE OF CORRECTION

PATENT NO. : 4,636,255

DATED : January 13, 1987

INVENTOR(S) : TSUDA ET AL

It is certified that error appears in the above-identified patent and that said Letters Patent is hereby corrected as shown below:

In column 1, line 42, delete "semimetal" and insert --semi-metal--.

In column 1, line 47, delete "acceptable" and insert --acceptable--.

In column 1, line 66, delete "phosphorous" and insert --phosphorus--.

In column 2, line 20, delete "phosrus" and insert --phosphorus--.

In column 2, line 50, delete "Drawing" and insert --Drawings--.

In column 6, line 58, delete "phosphorous" and insert --phosphorus--.

In column 7, line 3, delete "were" and insert --was--.

UNITED STATES PATENT AND TRADEMARK OFFICE

CERTIFICATE OF CORRECTION

PATENT NO. : 4,636,255

DATED : January 13, 1987

INVENTOR(S) : Tsuda et al

It is certified that error appears in the above-identified patent and that said Letters Patent is hereby corrected as shown below:

In column 6, lines 55-56, delete "phosphorous" and insert --phosphorus--.

"promotor" should be spelled --promoter-- throughout.

Signed and Sealed this

Fifth Day of January, 1988

*Attest:*

DONALD J. QUIGG

*Attesting Officer*

*Commissioner of Patents and Trademarks*